US009015871B2

(12) United States Patent
Lin et al.

(10) Patent No.: US 9,015,871 B2
(45) Date of Patent: Apr. 28, 2015

(54) MANUAL-AUTOMATIC FLUSH DRIVING DEVICE

(75) Inventors: Feng Lin, Shanghai (CN); Weiye Chen, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 723 days.

(21) Appl. No.: 13/289,744

(22) Filed: Nov. 4, 2011
(Under 37 CFR 1.47)

(65) Prior Publication Data

US 2012/0246815 A1 Oct. 4, 2012

Related U.S. Application Data

(63) Continuation-in-part of application No. PCT/CN2010/072504, filed on May 7, 2010.

(30) Foreign Application Priority Data

May 7, 2009 (CN) ..... 2009 2 0071715 U

(51) Int. Cl.

| | |
|---|---|
| ***E03D 1/14*** | (2006.01) |
| ***E03D 5/10*** | (2006.01) |
| ***E03D 5/02*** | (2006.01) |
| ***E03D 5/092*** | (2006.01) |
| ***E03D 1/012*** | (2006.01) |

(52) U.S. Cl.
CPC ..... *E03D 5/105* (2013.01); *E03D 5/028* (2013.01); *E03D 5/092* (2013.01); *E03D 1/0125* (2013.01)

(58) Field of Classification Search
CPC ..... E03D 1/142
USPC ..... 4/300–442
See application file for complete search history.

(56) References Cited

FOREIGN PATENT DOCUMENTS

| | | | |
|---|---|---|---|
| CN | 2748528 | Y | 12/2005 |
| CN | 200967988 | Y | 10/2007 |
| CN | 101250897 | A | 8/2008 |
| CN | 201106204 | Y | 8/2008 |
| CN | 201395837 | Y | 2/2010 |
| JP | 2004-218326 | A | 8/2004 |
| JP | 2007-021075 | | 2/2007 |
| KR | 10-2009-0036444 | | 4/2009 |
| WO | WO-2010/127631 | A1 | 11/2010 |

OTHER PUBLICATIONS

Japanese Office Action in related App. No. 2012-508889 dated Jul. 23, 2013.

Korean Preliminary Rejection in related App. No. 10-2011-7029204.

State Intellectual Property Office of P.R. China, ISA/CN, PCT/CN2010/ 072504; Written Opinion and International Search Report, Aug. 3, 2010 (with English Translation) 10 pages.

*Primary Examiner* — Lori Baker
(74) *Attorney, Agent, or Firm* — Foley & Lardner LLP

(57) ABSTRACT

A flush driving device for a toilet includes a mounting bracket, a control panel that includes a sensing window and manual buttons, and a manual operating mechanism that includes bars cooperating with the manual buttons and rotating mechanisms connected with the bars. Rotating shafts of the rotating mechanisms are mounted in the mounting bracket. An automatic operating mechanism includes a driving motor, a rod controlled by the driving motor, and lifting mechanisms cooperating with the rod. The flush driving device also includes pull arms connected to both the rotating mechanisms and the lifting mechanisms for controlling the flush of the toilet.

20 Claims, 3 Drawing Sheets

MANUAL-AUTOMATIC FLUSH DRIVING DEVICE

CROSS-REFERENCE TO RELATED PATENT APPLICATIONS

The present application is a Continuation-In-Part of International Patent Application No. PCT/CN2010/072504, filed May 7, 2010, which claims priority to and the benefit of China P.R. Priority Application 200920071715.0, filed May 7, 2009. The disclosures of both of these applications are incorporated herein by reference in their entireties.

BACKGROUND

The present application relates to a manual-automatic integration flush driving device, and more particularly to a manual-automatic integration flush driving device used in the sanitary equipment, such as toilet.

In our daily life, most of the flush driving devices used in the toilets are manual, which bring inconvenience to the users of the manual control and may cause the spread of the bacteria by cross infection. The use of automatic flush mechanisms may advantageously address this issue.

In most conventional systems in which an automatic flush is used, a fixed capacity of water is used to flush urine or defecation. Given the prevailing desire to promote water savings, it is obviously a waste to flush urine and defecation using the same capacity of water. Consequently, it is beneficial for both water saving and using water effectively to provide automatic flushing mechanisms with either a large or small capacity of flushing water depending on the nature of the substance to be flushed (e.g., defecation or urine).

Published Chinese invention application number 200810035342.1 relates to an automatic flush driving device. It is disclosed that the respective flush of urine or defecation with the corresponding capacity of water may be completed by a clockwise or anti-clockwise rotation of cams driven by a driving motor. However, such an automatic flush driving device senses the target, such as the user's body, by means of a sensor in order to control the automatic flush by the driving motor. Such sensors and driving motors need electricity to work, and they will not work if the sensor is broken or the electricity is not reliably supplied.

Therefore, in this field, a flush driving device is needed, which integrates the manual and automatic flush driving devices together and can meet the needs of reliability and suitable size for the sanitary products.

SUMMARY

An exemplary embodiment relates to a flush driving device for a toilet that includes a mounting bracket and a control panel comprising a sensing window and manual buttons. The flush driving device also includes a manual operating mechanism that includes bars cooperating with the manual buttons and rotating mechanisms connected with the bars, wherein rotating shafts of the rotating mechanisms are mounted in the mounting bracket. The flush driving device also includes an automatic operating mechanism comprising a driving motor, a rod controlled by the driving motor, and lifting mechanisms cooperating with the rod. The flush driving device further includes pull arms connected to both the rotating mechanisms and the lifting mechanisms for controlling the flush of the toilet.

Another exemplary embodiment relates to a manual-automatic flush driving device connected with a toilet tank. The flush driving device includes a control panel comprising manual buttons and operating mechanisms behind the control panel for controlling the flush of the toilet tank, wherein the operating mechanisms comprise a manual operating mechanism cooperating with the manual buttons and an automatic operating mechanism. The manual operating mechanisms comprise rotating mechanisms that cause a transverse pushing force from the manual buttons to be converted to a vertical and upward force. The automatic operating mechanism comprises a driving motor, a rod controlled by the driving motor, and a lifting mechanism that can be raised up by the rod. The flush driving device further comprises pull arms connected with both of the rotating mechanisms and the lifting mechanisms.

Another exemplary embodiment relates to a flush driving device for a toilet that includes a first pull arm configured to provide a first amount of water for a flush of the toilet when actuated and a second pull arm configured to provide a second amount of water for a flush of the toilet when actuated, the second amount being less than the first amount. The flush driving device also includes a first lifting mechanism and a first bar coupled to the first pull arm and a second lifting mechanism and a second bar coupled to the second pull arm. The first and second lifting mechanisms may be actuated by an automatic operating mechanism configured to sense the presence of a user of the toilet. The first and second bars may also be actuated by a manual operating system configured to be operated by a user of the toilet.

DETAILED DESCRIPTION

The present application relates to a manual-automatic integration flush driving device. According to an exemplary embodiment, the device is connected with a toilet tank, and comprises a control panel, the operating mechanisms behind the control panel, and a mounting bracket. The control panel comprises a sensing window and manual buttons. The operating mechanisms comprise a manual operating mechanism and an automatic operating mechanism. The manual operating mechanism comprises bars cooperating with the manual buttons and rotating mechanisms connected with the bars. The rotating shafts of the rotating mechanisms are mounted in the mounting bracket. The automatic operating mechanism includes a driving motor, a rod controlled by the driving motor, and lifting mechanisms cooperating with the rod. The manual-automatic integration flush driving device further comprises pull arms connected to both of the rotating mechanisms and the lifting mechanisms. Therefore, with the integration of manual and automatic control, the structure of the flush driving device is simple and reliable.

One advantageous feature of the aforementioned exemplary embodiment is that it provides a manual-automatic integration flush driving device that is simple and reliable.

The various exemplary embodiments will be described with reference to the attached drawings, in which the same or similar structure or same or similar function of the present driving device are marked with the same numbers. It is understood that the attached drawings are just for the description of the exemplary embodiments, and are not intended as limitations to the scope of the appended claims.

Figure 1:
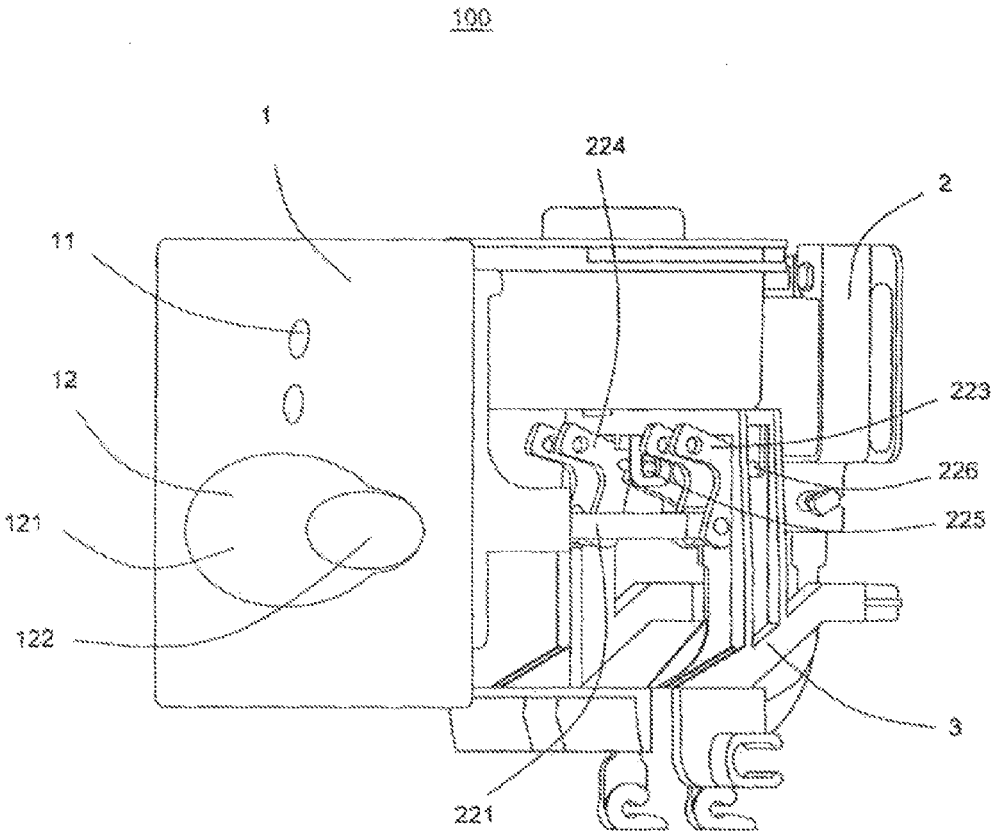
FIG. 1 is a schematic figure of a manual-automatic integration flush driving device according to an exemplary embodiment.
Figure 2:
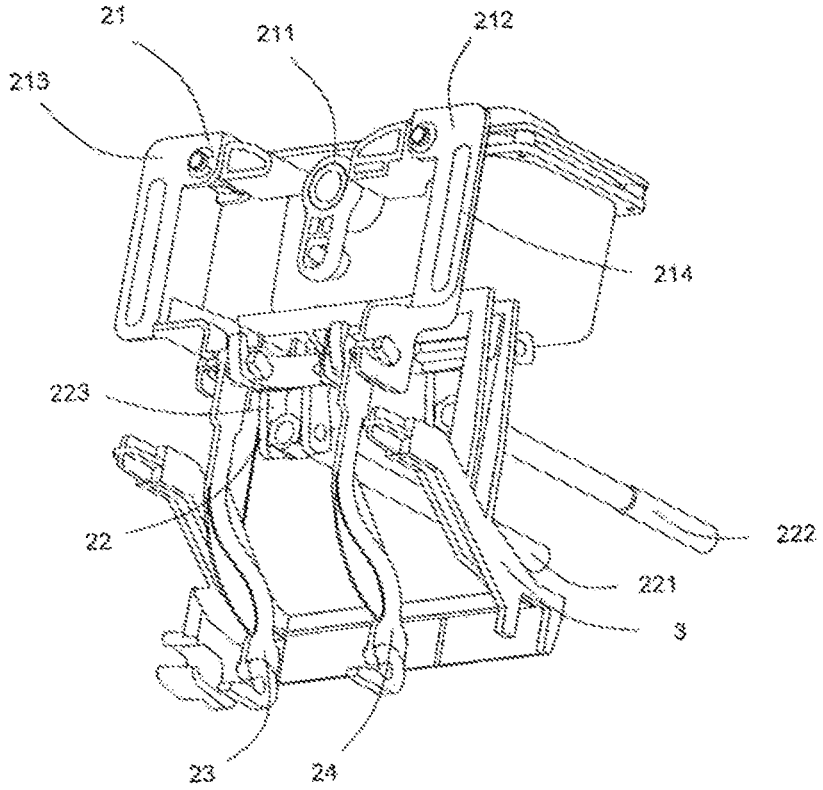
FIG. 2 is a partial schematic figure of the manual-automatic integration flush driving device according to an exemplary embodiment.
Figure 3:
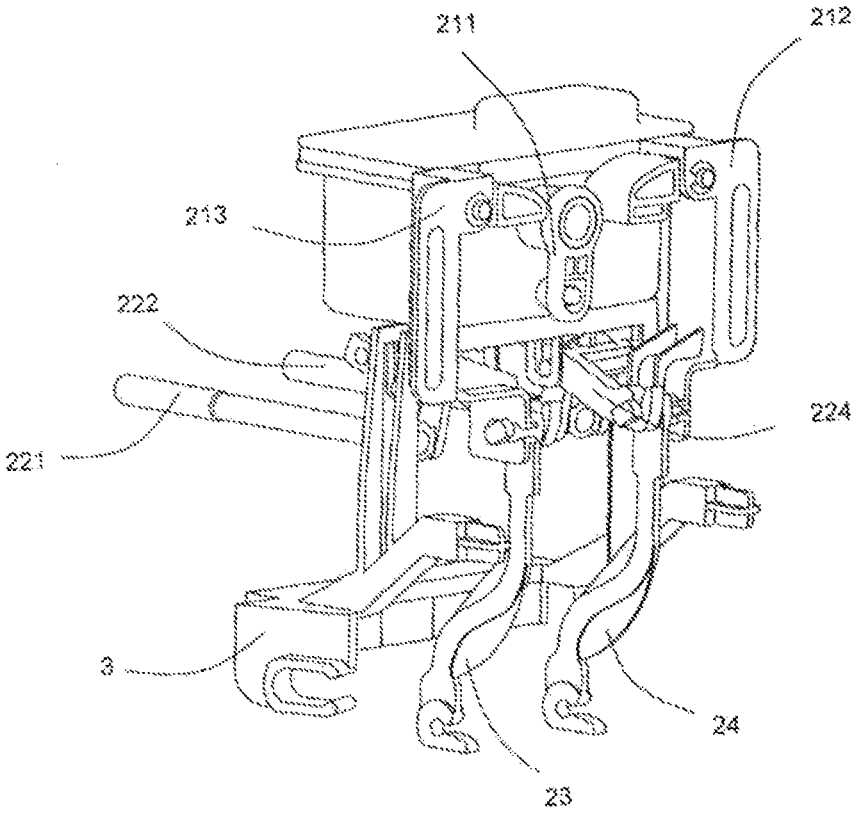
FIG. 3 is the schematic figure from another side of FIG. 2.

As shown from FIGS. 1-3, a manual-automatic integration flush driving device 100 is connected with a toilet tank having manual flush mode and automatic flush mode, and comprises a control panel 1, an operating mechanism 2 behind the control panel 1, and a mounting bracket 3.

The control panel 1 includes a sensing window 11 and a manual button 12. The manual button 12 has a button 121 for controlling the flush for defection (i.e., by providing a higher amount of water for the flush) and a button 122 for controlling the flush for urine (i.e., by providing a lesser amount of water for the flush). An infrared sensor is set at the back of the sensing window 11, and emits the infrared light obliquely and downwards through the sensing window 11 to sense a user entering/leaving the toilet area. According to another exemplary embodiment, the control panel 1 can work without the sensing window, and the way to sense could be the infrared sensing or some other sensing such as microwave sensing. The operating mechanism 2 comprises automatic and manual operating mechanisms 21, 22 and first and second pull arms 23, 24 connected to the plunger of the toilet tank to operate the flush for defecation or urine.

The automatic operating mechanism 21 comprises a driving motor (not shown in drawings) mounted in the mounting bracket 3, a rod 211 controlled by the driving motor, and a lifting mechanism 212 at the two sides of the rod 211. The lifting mechanism 212 comprises a first lifting mechanism 213 and a second lifting mechanism 214. The first or second lifting mechanism 213, 214 is respectively raised up when the rod 211 rotates anticlockwise or clockwise. The first or second lifting mechanisms 213, 214 are connected to the first or second pull arms 23, 24 for the corresponding flush for defecation or urine. The connection way between the first or second lifting mechanisms 213, 214 and the corresponding first or second pull arms 23, 24 is revolvable.

The manual operating mechanism 22 comprises first and second bars 221, 222 respectively touching the buttons 121, 122 of the manual button 12, and further comprises first and second rotating mechanisms 223, 224 connected to the first and second bars 221, 222. Rotating shafts 225, 226 of the rotating mechanisms 223, 224 are mounted in the mounting bracket 3, with one free end of the rotating mechanism 223/224 respectively connecting to the first and second bars 221, 222; and the other free end of the rotating mechanism 223/224 respectively connecting to the pull arms 23, 24. The connection way between the rotating mechanisms 223, 224 and the corresponding bars 221, 222, and between the rotating mechanisms 223, 224 and the corresponding pull arms 23, 24 is revolvable. While the manual button 12 transversely pushes one of the first and second bars 221, 222, the first and second rotating mechanisms 223, 224 begin rotating by the pushing force from the first and second bars 221, 222. The transverse force is converted to the vertical and upward force by means of the rotation of first and second rotating mechanisms 223, 224, and then the first or second pull arms 23, 24 are raised up further to control the corresponding flush for defecation or urine.

When the automatic flush mode is working, the infrared sensor detects that the user enters the toilet area, and then transmits the received signals to the Central Control Unit (CPU) to make the judgment. The CPU analyzes the signals and chooses the corresponding flush for defecation or urine, and further controls the driving motor to rotate clockwise or anticlockwise. The corresponding first or second lifting mechanisms 213, 214 are then raised up to cause the first pull arm 23 or the second pull arm 24 to move upwards so as to control the corresponding flush for defecation or urine.

According to an exemplary embodiment, the user can also control the flush manually. While the manual flush mode is working, the button 121 for controlling the flush for defection or button 122 for controlling the flush for urine is pressed to drive the corresponding first bar 221 or second bar 222, and the first or second rotating mechanisms 223, 224 then rotates; the free ends of the rotating mechanisms 223, 224 connected with the first or second pull arm 23, 24 causes the first or second pull arms 23, 24 to move upwards, further to control the corresponding flush for defecation or urine. In the manual flush mode, the manual operating mechanism 22 works independently without being affected by the automatic operating mechanism 21.

The automatic operating mechanism 21 and the manual operating mechanism 22 of the manual-automatic integration flush driving device 100 in the present invention can work separately and share the first and second pull arms 23, 24, which makes the structure simple and reliable. Further, it is easy to maintain the device 100 with above structure, and the size thereof can be controlled within a small scope. If no power supply is present, the manual flush mode of the device 100 can work independently.

The connection way between the first and second pull arms 23, 24 and the corresponding first and second rotating mechanisms 223, 224 is revolvable. The transverse pushing force received by the rotating mechanisms 223, 224 is converted to the vertical and upward force to pull arms 23, 24 by means of the rotation of the rotating mechanisms 223, 224. The rotating and lifting mechanisms are not always connected to the tank plunger by the pull arm, but by the pull string that is similar to the pull arm. The bar and the rotating mechanism could be set as a whole in order to make the structure simple. In fact, the driving device of present invention also can be applied as the manual-automatic integration flush driving device with the single flush mode only.

According to an exemplary embodiment, the manual-automatic integration flush driving device connected with a toilet tank comprises a control panel, the operating mechanisms behind the control panel, and a mounting bracket. The control panel comprises a sensing window and the manual buttons. The operating mechanisms comprise a manual operating mechanism and an automatic operating mechanism. The manual operating mechanism has the bars cooperating with the manual buttons and the rotating mechanisms connected with the bars. The rotating shafts of the rotating mechanisms are mounted in the mounting bracket. The automatic operating mechanism comprises a driving motor, a rod controlled by the driving motor, and the lifting mechanisms cooperating with the rod. The manual-automatic integration flush driving device further comprises pull arms connected to both of the rotating mechanisms and the lifting mechanisms.

Further, the connection way between the pull arms and the corresponding rotating mechanisms is revolvable.

Further, the connection way between the bars and the corresponding rotating mechanisms is revolvable.

Further, the manual buttons include a button for controlling the flush to defection and a button for controlling the flush to urine; the bars of the manual operating mechanism comprises a first bar and a second bar, respectively connected to the two buttons controlling the flush to defection or urine, and a first rotating mechanism and a second rotating mechanism.

Further, the lifting mechanisms of the automatic operating mechanism comprise the first and second lifting mechanisms respectively located at the two sides of the rod that can rotate clockwise or anticlockwise.

Further, the pull arms comprise a first pull arm and a second pull arm respectively cooperated with the first and second rotating mechanisms and the first and second lifting mechanisms.

Further, the present flush driving device comprises an infrared sensor that locates at the back of the sensing window and emits the infrared light obliquely and downwards.

According to another exemplary embodiment, a manual-automatic integration flush driving device connected with a toilet tank comprises a control panel, the operating mechanisms behind the control panel for controlling the toilet tank to flush, and a mounting bracket. The manual buttons are set on the control panel. The operating mechanisms comprise a manual operating mechanism cooperating with the manual buttons, and an automatic operating mechanism. The manual operating mechanism comprises the rotating mechanisms that cause the transverse pushing force from the manual buttons to be converted to the vertical and upward force. The automatic operating mechanism comprises a driving motor, a rod controlled by the driving motor and the lifting mechanisms that can be raised up by the rod. The present manual-automatic integration flush driving device further has the pull arms connected with both of the rotating mechanisms and the lifting mechanisms.

Further, the connection way between the pull arms and the corresponding rotating mechanisms is revolvable.

Further, the present driving device also comprises the bars set between the manual buttons and the rotating mechanisms, and the connection way between the bars and the corresponding rotating mechanisms is revolvable.

Comparing with known systems, the present driving device is organized simply and reliable by combining the manual operating mechanism and the automatic operating mechanism skillfully, which meets the needs of suitable size for the sanitary products.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A flush driving device for a toilet, comprising:

a mounting bracket;

a control panel comprising a sensing window and manual buttons;

a manual operating mechanism comprising bars cooperating with the manual buttons and rotating mechanisms connected with the bars, wherein rotating shafts of the rotating mechanisms are mounted in the mounting bracket;

an automatic operating mechanism comprising a driving motor, a rod controlled by the driving motor, and lifting mechanisms cooperating with the rod; and pull arms connected to both the rotating mechanisms and the lifting mechanisms for controlling the flush of the toilet.

2. The flush driving device of claim 1, wherein the connection between the pull arms and the corresponding rotating mechanisms is revolvable.

3. The flush driving device of claim 2, wherein the connection between the bars and the corresponding rotating mechanisms is revolvable.

4. The flush driving device of claim 1, wherein the manual buttons comprise a first button for providing a larger amount of water in a flush and a second button for providing a smaller amount of water in a flush, and wherein the bars of the manual operating mechanism comprise a first bar and a second bar respectively connected to the first and second buttons.

5. The flush driving device of claim 4, wherein the lifting mechanism of the automatic operating mechanism comprises first and second lifting mechanisms respectively at two sides of the rod that rotates clockwise or anticlockwise.

6. The flush driving device of claim 5, wherein the pull arms comprise a first pull arm and a second pull arm that respectively cooperate with the first and second rotating mechanisms and the first and second lifting mechanisms.

7. The flush driving device of claim 1, further comprising an infrared sensor located at the back of the sensing window that emits infrared light obliquely and downwards.

8. A manual-automatic flush driving device connected with a toilet tank, comprising:

a control panel comprising manual buttons; and operating mechanisms behind the control panel for controlling the flush of the toilet tank, wherein the operating mechanisms comprise a manual operating mechanism cooperating with the manual buttons and an automatic operating mechanism; and wherein the manual operating mechanisms comprise rotating mechanisms that cause a transverse pushing force from the manual buttons to be converted to a vertical and upward force;

wherein the automatic operating mechanism comprises a driving motor, a rod controlled by the driving motor, and lifting mechanisms that can be raised up by the rod; and wherein the flush driving device further comprises pull arms connected with both of the rotating mechanisms and the lifting mechanisms.

9. The flush driving device of claim 8, wherein the connection between the pull arms and the corresponding rotating mechanisms is revolvable.

10. The flush driving device of claim 9, further comprising bars set between the manual buttons and the rotating mechanisms, and the connection between the bars and the corresponding rotating mechanisms is revolvable.

11. A flush driving device for a toilet, comprising:

a first pull arm configured to provide a first amount of water for a flush of the toilet when actuated;

a second pull arm configured to provide a second amount of water for a flush of the toilet when actuated, the second amount being less than the first amount;

a first lifting mechanism and a first bar coupled to the first pull arm; and a second lifting mechanism and a second bar coupled to the second pull arm;

wherein the first and second lifting mechanisms may be actuated by an automatic operating mechanism configured to sense the presence of a user of the toilet; and wherein the first and second bars may be actuated by a manual operating system configured to be operated by a user of the toilet.

12. The flush driving device of claim 11, wherein the automatic operating mechanism comprises an infrared sensor.

13. The flush driving device of claim 11, wherein the infrared sensor emits an infrared light to sense the user of the toilet.

14. The flush driving device of claim 11, wherein the automatic operating mechanism comprises a driving motor and a rod controlled by the driving motor, wherein the rod is configured to rotate to move the first and second lifting mechanisms.

15. The flush driving device of claim 11, wherein the manual operating mechanism includes a first button coupled to the first bar and a second button coupled to the second bar, wherein the first bar may be moved by pressing the first button and the second bar may be moved by pressing the second button.

16. The flush driving device of claim 11, further comprising a first rotating mechanism coupled to the first bar and a second rotating mechanism coupled to the second bar.

17. The flush driving device of claim 16, further comprising a mounting bracket, wherein the first and second rotating mechanisms are coupled to the mounting bracket.

18. The flush driving device of claim 17, wherein the first rotating mechanism comprises a first rotating shaft and the second rotating mechanism comprises a second rotating shaft.

19. The flush driving device of claim 18, wherein the first rotating shaft is coupled to the first bar and to the first pull arm and the second rotating shaft is coupled to the second bar and the second pull arm.

20. The flush driving device of claim 19, wherein the first and second rotating mechanisms are configured to translate a force from the first or second buttons to the first or second pull arms.

* * * * *